US005794399A

United States Patent [19]

Searer

[11] Patent Number: 5,794,399

[45] Date of Patent: *Aug. 18, 1998

[54] COMBINED MOLDING AND MOLDING CAPS

[75] Inventor: Floyd A. Searer, Elkhart, Ind.

[73] Assignee: FAS Industries, Inc., Elkhart, Ind.

[ * ] Notice: The term of this patent shall not extend beyond the expiration date of Pat. No. 5,692,354.

[21] Appl. No.: 848,028

[22] Filed: Apr. 28, 1997

Related U.S. Application Data

[63] Continuation-in-part of Ser. No. 675,575, Jul. 3, 1996, Pat. No. 5,692,354.

[51] Int. Cl.[6] ..... E04F 19/02

[52] U.S. Cl. ..... 52/718.01; 52/716.1; 52/716.4; 52/717.04; D25/136

[58] Field of Search ..... 52/718.01, 718.02, 52/716.4, 716.5, 716.1, 717.03, 717.04, 717.05; D25/136, 137

[56] References Cited

U.S. PATENT DOCUMENTS 5,692,354 12/1997 Searer ..... 52/718.01

OTHER PUBLICATIONS

ABTCO Advertisement 1994.

*Primary Examiner*—Christopher Kent

*Attorney, Agent, or Firm*—Watson Cole Grindle Watson, PLLC.

[57] ABSTRACT

A combined molding cap and molding strip with the molding strip having opposed attachment surfaces extending along a longitudinal axis, a plurality of beaded ridges extending along one attachment surface of the molding strip, and a plurality of fluted channels extending along the opposed attachment surface of the molding strip. The molding cap has a surface including at least one of complementary fluted channels and beaded ridges for respectively engaging the beaded ridges and fluted channels of the molding strip.

9 Claims, 3 Drawing Sheets

COMBINED MOLDING AND MOLDING CAPS

BACKGROUND OF THE INVENTION

1. Related Applications

This application is a continuation-in-part application of application Ser. No. 08/675,575, filed 3 Jul. 1996, and is now U.S. Pat. No. 5,692,354, issued 2 Dec. 1997.

2. Field of the Invention

This invention relates to fixtures for finishing interior and exterior surfaces and, in particular, to such surfaces where it is desired to use a combination of a molding strip and molding cap(s) to provide a "finished" surface or appearance to building structures and especially in the interior of buildings, houses, recreational vehicles, etc. That is wherever molding strips and caps themselves are normally employed in such structures.

3. Related Art

The following U.S. Patents are believed to be representative of the general state of the art with respect to the combined molding and molding cap structure forming the subject invention:

(1) U.S. Pat. No. 850,866 (Clements), entitled "CURBING", discloses a curbing ledge with longitudinally extending grooves for receiving cement to secure the curbing to the sidewalk;

(2) Des. No. 51,508 (Plym) illustrates a threshold plate having a raised, fluted exterior surface;

(3) Des. No. 131,025 (O'Brien) is a design for a conduit with a fluted curved exterior surface;

(4) Des. 210,821 (Stone) discloses a "Decorative Molding Strip" with a "scalloped" surface and including a molding cap attached to one end thereof;

(5) Des. 211,629 (Massagli) illustrates a "Construction Panel" with one side beaded and the opposing side having paired fluted portions;

(6) Des. 269,910 (Johansson) shows a combination articulation rail and connecting bar for screen walls showing a curved, fluted surface covering a chambered channel member;

(7) Des. 283,357 (Bancroft) is directed to a "Vent Sill Rail Extrusion" having fluted surface areas; and (8) Des. 312,599 (Johnston) illustrates a "Tailgate Reinforcement" with fluted side surfaces.

There is a need in the building trades industry for the combination of a prefabricated molding strip and molding cap and wherein the versatility of the combined molding strip and molding cap are increased by providing at least one of the two opposing sides of the molding strip with a surface of different configuration, such as fluted channels or beaded ridges. And wherein each of two molding caps has a structured surface respectively conforming to the configured surface of the molding strip that is exposed to view so that one or more of the prefabricated molding caps can be easily attached to the molding strip at any preferred location along the longitudinal axis thereof.

SUMMARY OF THE INVENTION

A primary object of the invention is to provide a prefabricated two-sided molding strip with one side forming an attachment surface and an opposing side having a configured surface and molding caps attachable thereto with a minimum of effort on the part of the craftsman at the work site.

A primary feature of the invention is to provide a more versatile prefabricated molding strip with one side surface having a configured surface of one of several differently configured shapes such as fluted or beaded ridges and an opposing surface forming an attachment surface. A molding cap assembly comprises a respective attachment surface complementing a respective one of the differently configured side surfaces of the molding strip, whereby one type of the molding caps is readily attachable and affixed to the molding strip on the configured surface thereof and at any desired location along the longitudinal axis thereof.

An advantage of the combined molding strip and molding cap of the invention is the increased versatility afforded the on site construction craftsperson in selecting the prefabricated design of the surface of the molding strip that is exposed to view, while also enabling a prefabricated matching molding cap to be affixed to the selected exposed surface of the molding strip.

Another object of the invention is to provide an easier and more accurate way of aligning the molding and molding cap with respect to one another on site.

Another feature of the invention is that the combined molding strip and molding cap are automatically aligned with respect to one another because the molding cap has prefabricated attachment surface features conforming to the exposed surface features of the molding strip such that the molding strip and the molding cap are easily aligned with respect to one another to be engaged in closely abutting relationship with one another.

Another advantage of the invention is that the molding strip and the molding cap are readily mated in aligned relation to one another without the use of any additional aligning tools such as a carpenter's level or square.

A further object of the invention is that the molding cap of the invention is readily fastened at different locations along the longitudinal axis of the molding strip, thereby affording easy adjustment of the location of the molding cap with respect to the longitudinal axis of the molding strip.

A further feature of the invention is that the same matched attachment surface features of the molding cap with the surface features of the exposed surface of the molding strip also enable the molding cap to be re-located by sliding along the exposed surface of the molding strip.

A further advantage of the invention is that the position of the molding cap with respect to the longitudinal axis of the molding strip is easily and readily altered without the need to realign the molding cap and the molding strip with respect to one another.

Yet a further object of the invention is to provide a combined molding strip and molding cap that is made in essentially flat or curved cross section.

Yet a further feature of the invention is that the combined molding strip and molding cap of the invention are produced in either flat or curved cross section, and wherein the curved cross section is selectable in either 45 or 90 degree radii.

Yet a further advantage of the invention is that the observable shape of the combined molding strip and molding cap of the invention are easily selectable to be flat or curved, thereby providing a combined molding strip and molding cap that vary in appearance.

BRIEF DESCRIPTION OF THE DRAWINGS

The above objects, features and advantages of the invention are readily apparent from the following description of preferred embodiments of the best mode of carrying out the invention when taken in conjunction with the following drawings, wherein.

DETAILED DESCRIPTION

Figure 1:
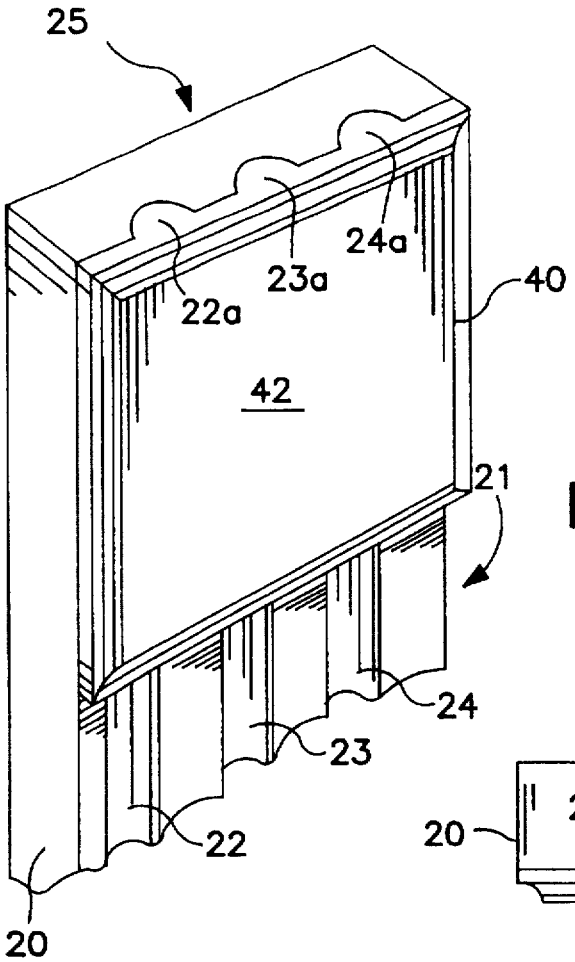
FIGS. 1–3 are respective front perspective, top and side views of a combined molding strip and molding cap in accordance with the invention, and wherein the molding strip includes a fluted front surface and a flat back surface with the fluted surfaces of the molding strip being observable, and with the attachment surface of the molding cap matching the fluted surfaces of the molding strip.
Figure 2:
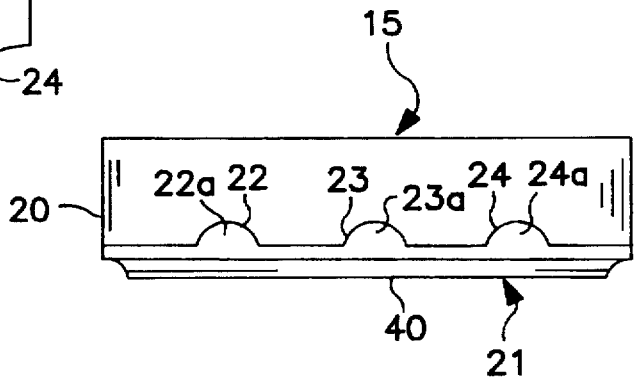
Figure 3:
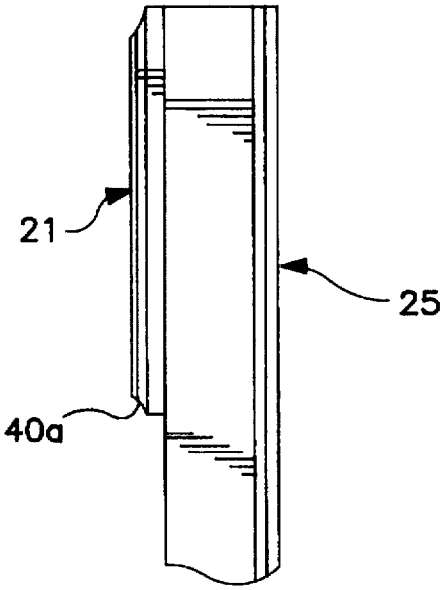

With respect to FIGS. 1–3, a first embodiment of the invention comprises a two-sided molding strip 20 with one fluted surface 21 having longitudinally-extending fluted channels 22, 23, 24 and the opposing surface 25 having a flat surface for mounting to a desired ceiling, wall or floor surface. A cove-edged molding cap 40 is shown mated to the fluted surface 21 of the molding strip 20 by the engagement of longitudinally extending beaded ridges 22*a*, 23*a*, 24*a* of the molding cap 40 respectively within longitudinally extending fluted channels 22, 23, 24 of the molding strip 20. Longitudinally-extending ridges 22*a*, 23*a*, 24*a* have a slightly smaller radius than the radius of fluted channels 22, 23, 24 so that molding cap 40 is capable of sliding along the length of molding strip 20 to be fastened at any position along the length thereof. A plurality of molding caps similar to molding cap 40 may be attached at various and sundry locations along the length of molding strip 20, for example at the top, bottom and midlength thereof.

Molding strip 20 is fastened to any ceiling, wall or floor surface (not shown) by any of the fastening techniques known to the building or construction trades, such as nails, staples, adhesives, etc. with surface 25 being attached to the ceiling, wall or floor surface in abutting engagement with the structural surface of the building.

In FIG. 1 molding cap 40 is shown with a plane face 42; however as is described hereinafter, the molding cap 40 may also include a Rosette-type design, i.e. a design having three-dimensional characteristics. Furthermore, molding cap 40 may also comprise a different style or type of molding cap other than a "cove edge" type molding cap illustrated herein. The particular type or design of molding cap only affects the appearance aspects of the invention. The significant critical aspect of the molding cap is that it have a configured surface capable of "mating" with the configured surface of the molding strip with which it is associated.

It is readily apparent that the sliding engagement of the molding cap(s) 40 with a molding strip 20 as described above affords a simple and accurate way of automatically aligning and positioning the molding cap(s) and molding strip with one respect to one another without additional alignment steps such as are required with conventional molding cap(s) and molding strips.

FIG. 2 shows the "mated" relationship of the fluted channels 22, 23 and 24 of side 21 of the molding strip with beaded ridges 22*a*, 23*a* and 24*a* of the molding cap 40. The complementary shapes of the flutes and the beaded ridges enables the molding cap 40 to be slid along the length of molding strip 20 to any desired position. It is this engagement capability of the invention that provides a significant versatility to the craftsman in situ in assembling the molding caps to the molding strip that is of significant importance to the invention.

Figure 4:
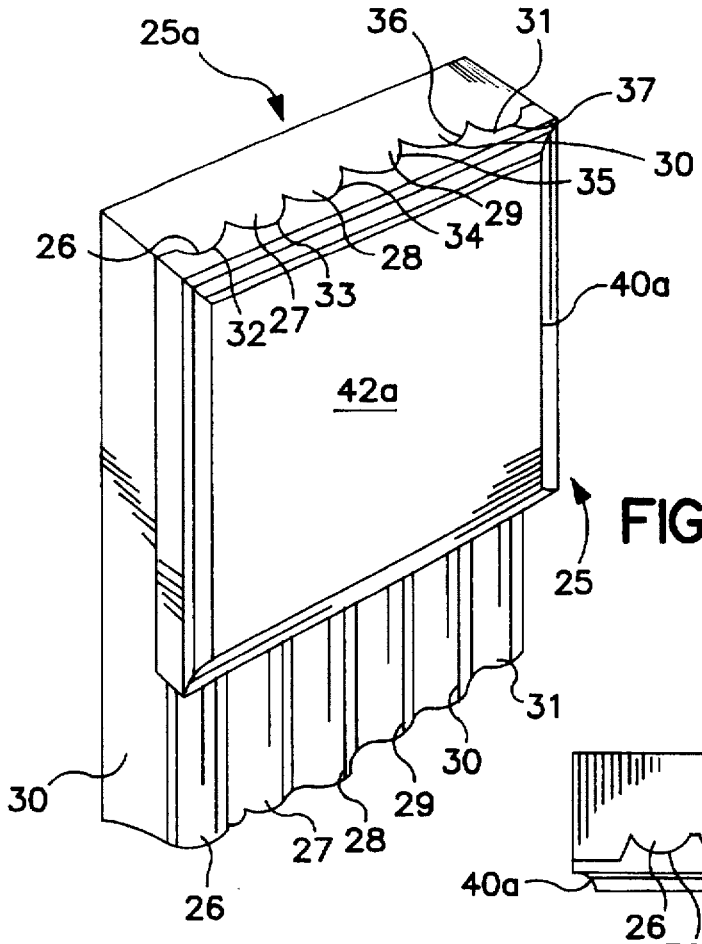
FIGS. 4–6 are respective perspective front, top and side views of the same embodiment of the invention as shown in FIGS. 1–3, but with the exposed side of the molding strip including a beaded surface and the attachment surface of the molding cap matches the beaded surface of the molding strip.
Figure 5:
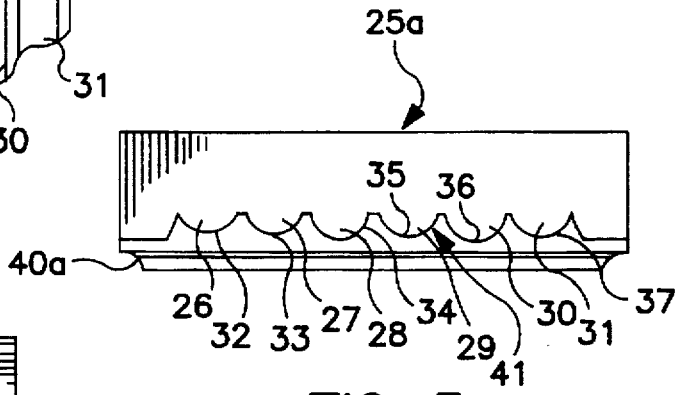
Figure 6:
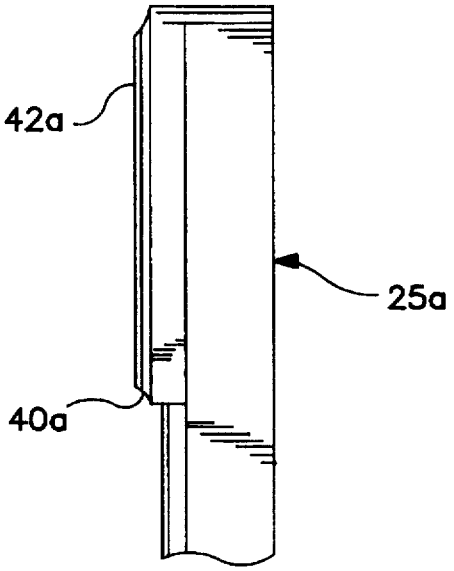

The following description is taken with respect to FIGS. 4–6 wherein the same embodiment as FIGS. 1–3 is illustrated with the exception that the molding strip 30 has beaded ridges 26, 27, 28, 29, 30 and 31 in the exposed or viewable position, and with another type molding cap 40*a* attached to viewable surface 25. In this second embodiment of the invention, molding cap 40*a* is of another type having structural features on mating surface 41 that match the beaded ridges 26, 27, 28, 29, 30 and 31 of surface 25 of molding strip 30. In this embodiment, the matching surface features are fluted channels 32, 33, 34, 35, 36 and 37 on molding cap 40*a*. All the above-described features and advantages of the combined molding strips and molding caps with respect to FIGS. 1–3 are applicable to the molding strips and molding caps of FIG. 4–6.

Figure 7:
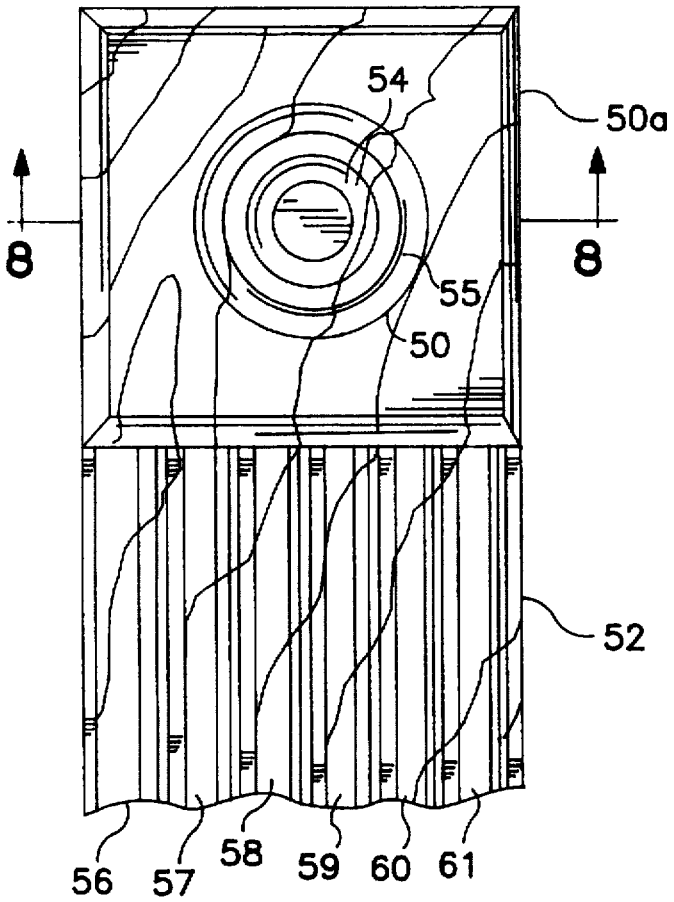
FIGS. 7 shows a front view of a combined molding strip and molding cap in accordance with the invention wherein the molding cap includes a rosette-type design in the face thereof.
Figure 8:
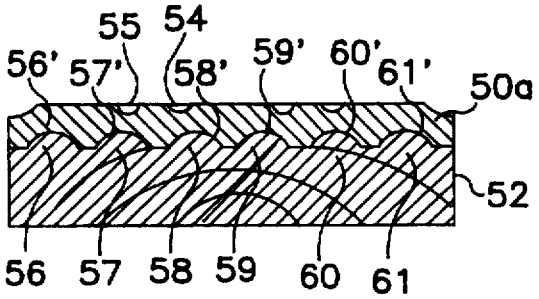
FIG. 8 shows a cross section along the lines 8—8 of FIG. 7 illustrating the clearance between the depth of the Rosette-type design and the attachment surface of the molding cap.

The molding caps of the invention may be produced with different patterns on surface 42*a* of FIG. 4 and also with a three-dimensional design such as the Rosette-type design 50 as illustrated in FIG. 7. The Rosette-type design 50 is illustrated in cross-section in FIG. 8 wherein molding cap 50*a* is shown mated with molding strip 52 and respective concentric rings 54 and 55 are shown in FIG. 8. The depth of concentric rings 54 and 55 is such so that there is no interference with the mating of beaded ridges 56, 57, 58, 59, 60 and 61 of molding strip 52 with fluted channels 56', 57', 58', 59', 60' and 61' of molding cap 50*a*.

It is evident to one of ordinary skill in the carpentry art that the combined molding cap(s) and molding strip of the invention as described herein provides a stable mating of the molding cap(s) and the molding strip because of the amount of direct surface contact with one another.

The molding caps of the invention are attached to a molding strip by adhesives, staples or nails as such attachment means are well known to those skilled in the carpentry art.

It is evident from a consideration of the foregoing description that, although only a portion of the molding strips are shown, the molding caps may be attached to portions of the molding strip other than the portions illustrated in the various drawings. In that connection it is also evident that the molding caps, once engaged with the molding strip, may be slid along the surface thereof until the desired point of attachment is reached, thereby providing an easy way to determine the most ideal position at which to attach the molding cap to the molding strip.

The above description serves only to describe exemplary embodiments of the best mode of making the combined molding cap(s) and molding strips of the invention to demonstrate the features and advantages of its construction and operation. The invention is not intended to be limited thereby, as those skilled in the carpentry art will readily perceive modifications of the above-described embodiments. Thus the invention is intended to be limited only by the following claims and the equivalents to which the claimed components thereof are entitled.

What is claimed is:

1. A combined molding cap and molding strip, comprising:

a molding strip having a substantially flat attachment surface and a substantially planar, opposing non-attachment surface extending along the longitudinal axis thereof;

a plurality of at least one of beaded ridges and fluted channels extending along said substantially planar non-attachment surface of the molding strip; and at least one molding cap having a substantially planar surface including at least one of complementary fluted channels and beaded ridges for respectively engaging the plurality of at least one beaded ridges and fluted channels of the substantially planar non-attachment surface of the molding strip so that said at least one molding cap is in closely abutting relationship with said molding strip at a desired location along said longitudinal axis.

2. A combined molding cap and molding strip according to claim 1, wherein the at least one molding cap is attached to the molding strip by adhesive.

3. A combined molding cap and molding strip according to claim 1, wherein the at least one molding cap and the molding strip are attached by nails or staples.

4. A combined molding cap and molding strip according to claim 1, wherein the surface of the at least one molding cap opposite the surface having at least one of complementary fluted channels and beaded ridges includes a three-dimensional pattern.

5. A combined molding cap and molding strip according to claim 4, wherein the three dimensional pattern is a Rosette-type pattern.

6. A molding strip for use with at least one molding cap having a substantially planar attachment surface including at least one of complementary beaded ridges and fluted channels, said molding strip comprising:

an elongated strip of finishing material having a substantially flat attachment surface and an opposing substantially planar non-attachment surface extending along the longitudinal axis thereof; and a plurality of at least one of complementary beaded ridges and a plurality of complementary fluted channels extending along the substantially planar non-attachment surface of the molding strip and adapted to mate with the substantially planar complementary attachment surface of the molding cap.

7. A molding cap for use with a molding strip having a flat attachment surface and a substantially planar non-attachment surface with at least one of complementary beaded ridges and fluted channels, comprising:

at least one attachment surface including at least one of complementary fluted channels and beaded ridges and adapted to be in closely abutting relationship with at least one of the complementary beaded ridges and fluted channels of the non attachment-surface of the molding strip.

8. A molding cap according to claim 7, wherein an exposed surface opposing said attachment surface includes a three-dimensional pattern.

9. A molding cap according to claim 8, wherein said three-dimensional pattern is a Rosette-type pattern.

* * * * *